US010063981B2

(12) United States Patent
Westerkull

(10) Patent No.: US 10,063,981 B2
(45) Date of Patent: Aug. 28, 2018

(54) BONE CONDUCTION HEARING AID SYSTEM

(71) Applicant: MED-EL Elektromedizinische Geraete GmbH, Innsbruck (AT)

(72) Inventor: Patrik Westerkull, Askim (SE)

(73) Assignee: MED-EL Elektromedizinische Geraete GmbH, Inssbruck (AT)

( * ) Notice: Subject to any disclaimer, the term of this patent is extended or adjusted under 35 U.S.C. 154(b) by 39 days.

(21) Appl. No.: 15/018,911

(22) Filed: Feb. 9, 2016

(65) Prior Publication Data

US 2016/0234613 A1 Aug. 11, 2016

Related U.S. Application Data

(63) Continuation-in-part of application No. PCT/US2014/046146, filed on Jul. 10, 2014, which is a continuation of application No. 13/963,186, filed on Aug. 9, 2013, now abandoned.

(51) Int. Cl.
*H04R 25/00* (2006.01)

(52) U.S. Cl.
CPC ..... *H04R 25/606* (2013.01); *H04R 25/60* (2013.01); *H04R 25/75* (2013.01); *H04R 2225/67* (2013.01); *H04R 2460/13* (2013.01)

(58) Field of Classification Search
CPC ..... H04R 25/606; H04R 25/60; H04R 25/75; H04R 2225/67; H04R 2460/13
USPC ..... 381/326
See application file for complete search history.

(56) References Cited

U.S. PATENT DOCUMENTS

| | | | | |
|---|---|---|---|---|
| 4,390,576 | A | 6/1983 | Hutter, III | |
| 6,377,693 | B1 | 4/2002 | Lippa et al. | |
| 7,386,143 | B2 * | 6/2008 | Easter | H04R 25/606 381/312 |
| 2008/0319250 | A1 | 12/2008 | Asnes | |
| 2011/0268303 | A1 * | 11/2011 | Ahsani | H04R 11/02 381/326 |
| 2012/0294466 | A1 | 11/2012 | Kristo et al. | |

(Continued)

OTHER PUBLICATIONS

International Searching Authority, International Search Report and Written Opinion for PCT/US2014/046146, dated Jan. 12, 2016, 7 pages.

*Primary Examiner* — Sean H Nguyen
(74) *Attorney, Agent, or Firm* — Sunstein Kann Murphy & Timbers LLP

(57) ABSTRACT

A bone conduction hearing aid system includes a hearing aid housing with a hearing aid vibrator. A skin interface has an interface connector offset on an outer interface surface and detachably connected to a housing connector. A skin adhesive connects to the skin of a patient user to transmit the sound vibrations through the skin to underlying skull bone for transmission by bone conduction to a hearing organ of the user. When the skin adhesive is pressed against the skin of the user, the skin is initially engaged during an initial engagement period with an initial adhesive force that promotes removal and relocation of the skin interface, and the skin is fully engaged after the initial engagement period with a full adhesive force greater than the initial adhesive force that promotes a fixed secure connection that resists removal of the skin interface.

23 Claims, 11 Drawing Sheets

(56) References Cited

U.S. PATENT DOCUMENTS

| | | | | |
|---|---|---|---|---|
| 2012/0302823 | A1* | 11/2012 | Andersson | H04R 25/606<br>600/25 |
| 2014/0064533 | A1* | 3/2014 | Kasic, II | H04R 25/60<br>381/329 |
| 2014/0233765 | A1* | 8/2014 | Andersson | H04R 25/606<br>381/151 |

* cited by examiner 108
104
112
120
109
106
110

108
109
110
(L)

109
108
110
106
F 109
108
104
113

BONE CONDUCTION HEARING AID SYSTEM

This application is a continuation-in-part of pending Patent Cooperation Treaty Application PCT/US2014/046146, filed Jul. 10, 2014, which in turn claims priority from U.S. patent application Ser. No. 13/963,186, filed Aug. 9, 2013, both of which are incorporated herein by reference in their entireties.

FIELD OF THE INVENTION

The present invention relates to a hearing aid system providing bone conduction hearing.

BACKGROUND ART

Bone conduction is the conduction of sound to the inner ear through the bones of the skull, and a bone conduction hearing aid, or bone conductor, is a device that stimulates through bone conduction. Other types of hearing aids may instead directly stimulate the tympanic membrane, the middle ear ossicles, the round window, the oval window or the cochlear fluid. Several different types of bone conduction hearing aids are available. A bone conduction hearing aid may amplify sound or it may also work as a tinnitus masker. A bone conductor may also be used in audiometry to determine bone conduction hearing thresholds. Current bone conductors include however several drawbacks, as described below.

The traditional bone conductor consists of a hearing aid with a vibrator that is pressed against the head behind the ear by a spring arrangement extending from the other side of the head. The steel spring arrangement is sometimes built into an eyeglass frame. The vibrations are transmitted through the skin and the skull bone into the inner ear. For the traditional bone conductors with a spring arrangement around the head, the constant pressure against the skull bone often causes headaches and skin irritation. The spring arrangement is also bulky and is not a practical or user friendly solution.

Another type of established bone conductor, which is sometimes called a direct bone conductor, includes a vibrator, which is directly and firmly connected to an anchoring component that is anchored to the skull bone through which the vibrations are directly transmitted from the vibrator to the skull bone. The vibrations do not pass through the skin on its way from the vibrator to the skull bone. This type of bone conductor may be designed with a permanent skin penetration which may lead to problems with skin infections. If this type of bone conductor is instead designed with an implanted vibrator and where energy are transmitted from an external hearing aid there is a significant energy loss when transmitting the energy with an inductive link through the skin. Another drawback is that the vibrator cannot easily be repaired if it breaks down.

Another type of bone conductor is a type where the vibrator is placed in an external unit outside the skin and where this external unit is kept in place through a magnetic attachment to a part that is anchored to the skull bone and implanted under the skin. In this arrangement, the signal from the external part is passing through the skin to the implanted part and the skull bone. For this type of bone conductor, surgery is still required and the magnetic force may cause skin necrosis due to the constant pressure against the skin and the hearing aid may also easily fall off.

JP 201 1087142 (A) presents a solution where a vibrator is attached to the skin of a user by means of an adhesive sheet. Although JP 201 1087142 (A) reduces the pressure against the head, it is still in need of further improvements in terms of functionality and comfort.

There is a need for a more effective bone conduction hearing aid system that is reliable and does not have the drawbacks discussed above.

SUMMARY OF THE INVENTION

The present invention provides an effective solution to the above outlined problems of bone conduction hearing aids. More particularly, the bone conduction hearing aid system of the present invention includes a hearing aid housing that contains a hearing aid vibrator configured for generating sound vibrations, and a housing connector configured for coupling out the sound vibrations from the hearing aid vibrator. A skin interface has opposing inner and outer interface surfaces, each having a front end and a rear end, wherein the front end is configured to be closer to an auricle of the ear of a patient user when the skin interface is attached to the patient user. An interface connector is located on the outer interface surface closer to the front end than to the read end and detachably connected to the housing connector to couple in the sound vibrations. A skin adhesive is located on the inner interface surface and configured to adhesively connect to skin of the patient user to transmit the sound vibrations through the skin to underlying skull bone for transmission by bone conduction to a hearing organ of the user. The skin adhesive is characterized by a surface texture configured so that when the skin adhesive is pressed against the skin of the user, the skin is initially engaged during an initial engagement period with an initial adhesive force that promotes removal and relocation of the skin interface, and the skin is fully engaged after the initial engagement period with a full adhesive force greater than the initial adhesive force that promotes a fixed secure connection that resists removal of the skin interface.

In further such embodiments, the skin adhesive texture is characterized by structural peaks and valleys in the range of 0.1 mm to 1 mm. In some embodiments there may be an implanted magnet fixedly attached to the skull bone under the skin of the patient user, wherein the skin interface includes an external magnet configured to magnetically cooperate with the implanted magnet to couple the sound vibrations through the skin to the skull bone.

The housing connector and the interface connector may possess a common center axis about which the hearing aid housing is rotatable. With the hearing aid device being rotatable to at least part of a turn, it is possible to somewhat adjust the orientation of the hearing aid device on the head of the user when the hearing aid device is connected to the skin interface that is adhesively attached to the skin of the user. This can be advantageous since the orientation of the hearing aid device on the head of the user can then be adjusted without having to tear off the skin interface from the skin to reposition it or to attach a new skin interface at a new position on the skin.

The skin interface may include one or more through holes extending between the inner and outer interface surfaces. The hearing aid vibrator may be suspended within the hearing aid housing so as to acoustically isolate the hearing aid vibrator from the hearing aid housing. And the hearing aid housing and the skin interface may each include magnets configured so that the housing connector and the interface connector are detachably magnetically connected.

Embodiments of the present invention also include a hearing aid housing containing a hearing aid vibrator configured for generating sound vibrations, and a housing connector configured for coupling out the sound vibrations from the hearing aid vibrator. A skin interface has rigid opposing inner and outer interface surfaces, each having a front end and a rear end, wherein the front end is configured to be closer to an auricle of the ear of a patient user when the skin interface is attached to the patient user. There is an interface connector located on the outer interface surface closer to the front end than to the read end and detachably connected to the housing connector to couple in the sound vibrations. A skin adhesive is located on the inner interface surface and configured to adhesively connect to skin of the patient user to transmit the sound vibrations through the skin to underlying skull bone for transmission by bone conduction to a hearing organ of the user. And a cushioning layer is in compliant engagement between the rigid inner interface surface and the skin adhesive to promote comfortable engagement of the hearing aid system with the skin of the patient user.

In further such embodiments, the rigid opposing inner and outer interface surfaces may be surrounded by an outer ring of flexible material, and the cushioning layer may be made of the same flexible material as the outer ring. The rigid opposing inner and outer interface surfaces may be at least partially embedded within the cushioning layer.

There may be an implanted magnet fixedly attached to the skull bone under the skin of the patient user, wherein the skin interface includes an external magnet configured to magnetically cooperate with the implanted magnet to couple the sound vibrations through the skin to the skull bone.

The housing connector and the interface connector may possess a common center axis about which the hearing aid housing is rotatable. With the hearing aid device being rotatable to at least part of a turn, it is possible to somewhat adjust the orientation of the hearing aid device on the head of the user when the hearing aid device is connected to the skin interface that is adhesively attached to the skin of the user. This can be advantageous since the orientation of the hearing aid device on the head of the user can then be adjusted without having to tear off the skin interface from the skin to reposition it or to attach a new skin interface at a new position on the skin.

The skin interface may include one or more through holes extending between the inner and outer interface surfaces. The hearing aid vibrator may be suspended within the hearing aid housing so as to acoustically isolate the hearing aid vibrator from the hearing aid housing. And the hearing aid housing and the skin interface may each include magnets configured so that the housing connector and the interface connector are detachably magnetically connected.

Embodiments of the present invention also include a hearing aid housing containing a hearing aid vibrator configured for generating sound vibrations, and a housing connector configured for coupling out the sound vibrations from the hearing aid vibrator. A skin interface has rigid opposing inner and outer interface surfaces, each having a front end and a rear end, wherein the front end is configured to be closer to an auricle of the ear of a patient user when the skin interface is attached to the patient user. There is an interface connector located on the outer interface surface closer to the front end than to the read end and detachably connected to the housing connector to couple in the sound vibrations. A skin adhesive is located on the inner interface surface and configured to adhesively connect to skin of the patient user to transmit the sound vibrations through the skin to underlying skull bone for transmission by bone conduction to a hearing organ of the user. The housing mass is may be least five times greater than the interface mass; for example, at least ten times greater.

There may be an implanted magnet fixedly attached to the skull bone under the skin of the patient user, wherein the skin interface includes an external magnet configured to magnetically cooperate with the implanted magnet to couple the sound vibrations through the skin to the skull bone.

The housing connector and the interface connector may possess a common center axis about which the hearing aid housing is rotatable. With the hearing aid device being rotatable to at least part of a turn, it is possible to somewhat adjust the orientation of the hearing aid device on the head of the user when the hearing aid device is connected to the skin interface that is adhesively attached to the skin of the user. This can be advantageous since the orientation of the hearing aid device on the head of the user can then be adjusted without having to tear off the skin interface from the skin to reposition it or to attach a new skin interface at a new position on the skin.

The skin interface may include one or more through holes extending between the inner and outer interface surfaces. The hearing aid vibrator may be suspended within the hearing aid housing so as to acoustically isolate the hearing aid vibrator from the hearing aid housing. And the hearing aid housing and the skin interface may each include magnets configured so that the housing connector and the interface connector are detachably magnetically connected.

The skin adhesive may be a separately arranged adhesive sheet having an outer skin adhesive surface configured to be connectable to the inner interface surface of the skin interface, and an inner skin adhesive surface configured to, when in use, being connectable to the skin of the user of the bone conduction hearing device. This is an efficient way to manufacture the skin adhesive on the skin interface and may also enable changing a worn out skin adhesive.

DETAILED DESCRIPTION OF SPECIFIC EMBODIMENTS

In the past, it has been assumed that it is necessary to apply a fairly large pressure to transmit bone conduction vibrations through the skin regardless of whether the bone conductor has been applied with an elastic or adhesive arrangement. In embodiment of the present invention, it has been surprisingly realized that bone conduction can work efficiently without any significant pressure being applied against the skin.

In prior art hearing aid systems, it was assumed that an adhesively attached bone conductor required an adhesive patch that extended over the hearing aid device so that the ends of the adhesive patch can be attached to the head. The prior art adhesive patch or band encloses the hearing aid device, and the adhesive is therefore attached directly to the top of the hearing aid device to hold the entire hearing aid system in place on the head of the user. But by stretching the adhesive patch over the hearing aid device, the adhesive patch also provides an inwardly directed pressure onto the hearing aid system that, in turn, is pressed against the skin. The adhesive attachment area on the head of the user may then also have to be quite large.

The present invention is based on the realization that an adhesive can be located between the hearing aid device and the skin on a contact area that is directly applied to the skin to hold the hearing aid system in place in a bare area behind the ear without hair. Although little or no pressure is applied on the skin by the adhesive, the sound vibrations from the hearing aid device are properly and effectively being conveyed into the skull bone. The fact that little or no pressure is applied on the skin, means the system is more comfortable to the user. In addition, the adherence is sufficiently strong so that the user can easily snap on and snap off the hearing aid device from the skin interface without tearing the skin interface off the skin. This makes it possible for the user to only attach the hearing aid device to the skin interface when necessary. and the user also can easily remove it without removing the skin interface when needed such as when sleeping or swimming.

Figure 1:
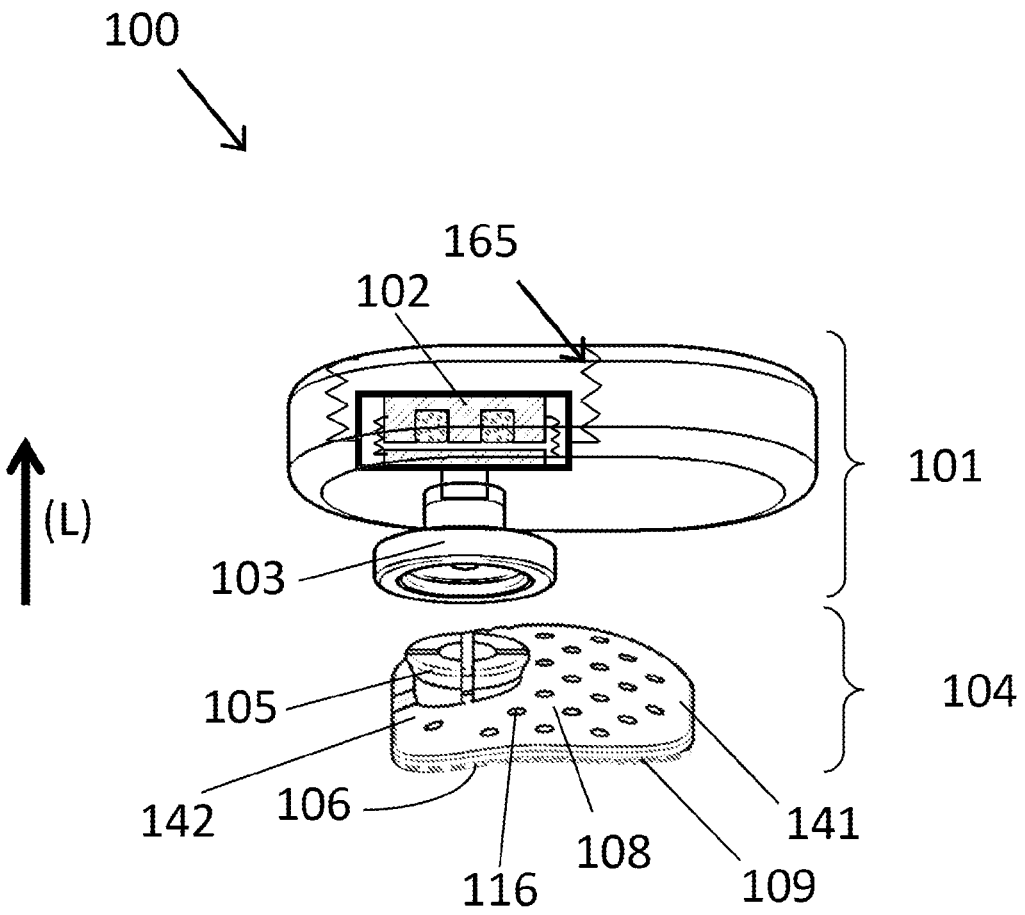
FIG. 1 is a perspective side view overviewing the bone conduction hearing aid system of the present invention when the hearing aid device is not connected to the skin interface, and where the vibrator of the hearing aid device has been visualized.

FIG. 1 is a perspective side overview of the bone conduction hearing aid system 100 according to one embodiment of the present invention. A hearing aid device 101 has a hearing aid vibrator 102 (shown as a cross-sectional view) disposed therein. The hearing aid vibrator 102 is connected to a housing connector 103 of the hearing aid device 101. A skin interface 104 has an outer interface surface 108 and an inner interface surface (not shown) opposite to the outer interface surface 108, which faces the skin of the patient user.

The outer interface surface 108 has an interface connector 105. The housing connector 103 and the interface connector 105 form a coupling since they are connectable to each other. The inner interface surface engages an adhesive surface 109. The lateral direction (L) has been marked. A contra-lateral direction may be a direction opposite to the lateral direction (L) and a lateral side of a component may be a side facing the lateral direction and a contra-lateral side may be facing a contra-lateral direction. The outer interface surface 108 may, for example, be a lateral side of the skin interface 104. The skin adhesive 109 has an inner skin adhesive surface 106 at the contra-lateral side of the adhesive surface 109. The skin adhesive 106 can be removably connected to the skin on the head of a user (best shown in FIG. 2) and the housing connector 103 can be removably connected to the interface connector 105 of the skin interface 104 by inserting a portion of the interface connector 103 into a cavity defined inside the portion 105. The hearing aid device 101 can transmit bone conduction vibrations to the hearing organ of the user (see FIG. 2). The lateral direction (L) may be defined as the direction pointing out from the patient's head when the bone conduction hearing aid system 100 is connected to the skin of the patient.

One useful feature is that the patient may simply remove the hearing aid device 101 by snapping the housing connector 103 from the interface connector 105, and it may, preferably, require less force to remove the housing connector 103 from the interface connector 105 compared to removing the skin adhesive 109 from the skin. In this way, the patient may easily remove the hearing aid device 101 from the skin interface 104 without inadvertently removing the skin interface 104 from the skin of the patient. To promote this, the housing connector 103 can be disconnected from the interface connector 105 by tilting it in relation to the interface connector 105, thus generating significantly less pulling forces on the skin from the inner skin adhesive surface 106 when disconnecting the hearing aid device 101 from the skin interface 104 that is adhesively attached to a user. To enable disconnecting the hearing aid device 101 from the skin interface 104 with a tilting force, the skin interface 104 is sufficiently rigid so that it is not deformed or bent when applying a tilting force since such deformation or bending may prevent the intended disconnection of the hearing aid device 101 from the skin interface 104 by using the above described tilting force.

Specifically, the connection between the housing connector 103 and the interface connector 105 may have a female-male configuration such that the hearing aid device 101 cannot slide in a sideways direction relative to the skin interface 104 i.e. in a direction that is perpendicular to the lateral direction (L). The housing connector 103 may specifically be a substantially rigid female connection portion, and the interface connector 105 may specifically be a male connection portion that consists of flexible and elastic protruding spring arms so that the housing connector 103 can be snapped onto the interface connector 105. It is also possible to make the interface connector 105 rigid and the housing connector 103 flexible and elastic. When the housing connector 103 has been snapped onto the interface connector 105, the flexible interface connector 105 establishes a coupling force that keeps the hearing aid device 101 and the skin interface 104 together and allows sound vibrations to be transmitted from the hearing aid vibrator 102 to the skin interface 104.

The housing connector 103 and the interface connector 105 may also include magnetic materials that adhere to one another so that the hearing aid device 101 is magnetically attached to the skin interface 104. If such magnets are used, the housing connector 103 and the interface connector 105 may also be configured to have mechanisms to prevent sideways movement such as by using protruding parts that prevent sideways movement of the housing connector 103 relative to the interface connector 105.

The hearing aid device 101 may, in general, also include a microphone, electronics, battery and volume control which are not shown in the drawings. The hearing aid device 101 may include a signal generator to generate for example a noise signal for tinnitus masking or tones for audiometry. The hearing aid device 101 may also be connected with a cord to a conventional audiometer for audiometry.

The skin interface 104 may include a plurality of through holes 116 defined therethrough so that air and moisture may be transported through the skin interface 104 to reach portions of the patient's skin that is below the inner skin adhesive surface 106. The through holes 116 allows for moisture and air transportation through the skin interface 104 which is beneficial to the skin to which the skin interface 104 is attached with the skin adhesive 109. In some embodiments, the skin interface 104 may have multiple through holes 116 defined therein and the skin interface 104 may also have a porous material for the same purpose.

The female housing connector 103 can be turned about the center axis of the coupling relative to the male interface connector 105 connected thereto. This is useful since it is then possible to adjust the orientation of the hearing aid device 101 when it is connected to the skin interface 104 attached to the user. There should be sufficient friction between the housing connector 103 and the interface connector 105 to provide that the hearing aid device 101 is still kept in an accurate position.

The outer interface surface 108 has a front end 141 and a rear end 142. The front end 141 is closer to the auricle of the user ear than the rear end 142 when the skin interface 104 is adhered to the skin behind the ear (best shown in FIG. 2). The interface connector 105 should be eccentrically positioned on the skin interface 104 so that the interface connector 105 is off-center and closer to or at the rear end 142. That positions the hearing aid device 101 further to the rear to avoid the hearing aid device 101 from touching the auricle of the user ear, preferably positioned on the naturally non-hair baring area behind the auricle since the adhesive attachment of the skin interface 104 would be less efficient on a hair baring area. Also not touching the auricle with the skin interface 104 avoids feedback and poor sound quality as well as discomfort.

The hearing aid device 101 may also include a vibrator suspension device 165 that suspends the hearing aid vibrator 102 within the housing of the hearing aid device 101 to minimize feedback problems. The hearing aid device 101 may also have a second high-frequency vibrator that has a resonance frequency higher than a resonance frequency of the hearing aid vibrator 102 to further boost the acoustic high frequency performance.

The interface connector 105 may be an elastic plastic snapping device and the housing connector 103 may be a more durable female connection so that the wear is on the male interface connector 105, which is more frequently changed, instead of the wear being on the hearing aid device 101 which would need to be sent to repair when worn out. However, it is also possible to design the housing connector 103 and the interface connector 105 so that the latter is more wear resistant than the former, and so that the female interface connector 105 is more flexible and elastic compared to the male housing connector 103. To achieve a stable and durable coupling, both the housing connector 103 and the interface connector 105 include some substantially rigid mechanical components. The mechanical coupling of the bone conduction hearing aid system 100 of the present invention is, normally, an arrangement between the hearing aid device 101 and the skin interface 104 that is quite stiff when these are connected to each other to ensure an efficient transmission of the sound vibrations from the hearing aid vibrator 102 of the hearing aid device 101 to the skin interface 104 without damping or distortion.

Figure 2:
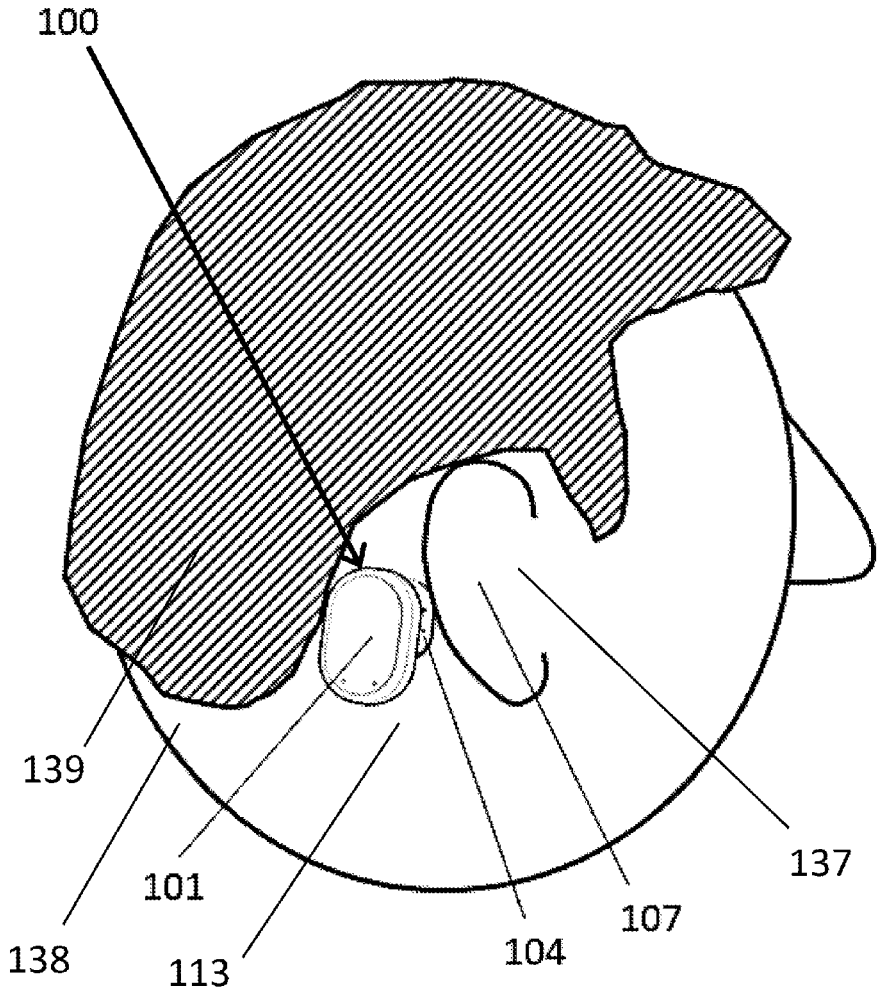
FIG. 2 is a perspective side view overviewing the bone conduction hearing aid system of the present invention when the bone conduction hearing aid system is connected to a user.

FIG. 2 is a perspective side overview of the bone conduction hearing aid system 100 of the present invention when it is in position on and attached to a skin 113 on the head 139 of the patient user 138. The hearing aid device 101 is connected to the skin interface 104 which is connected with a skin adhesive 109 to the skin 113 behind the ear auricle 107 of the user. Sound vibrations are transmitted from the hearing aid device 101 via the skin interface 104 to the head 139 of the user to stimulate the hearing organ 137 in the head 139 through bone conduction.

Figures 3A, 3B, 3C, 3D:
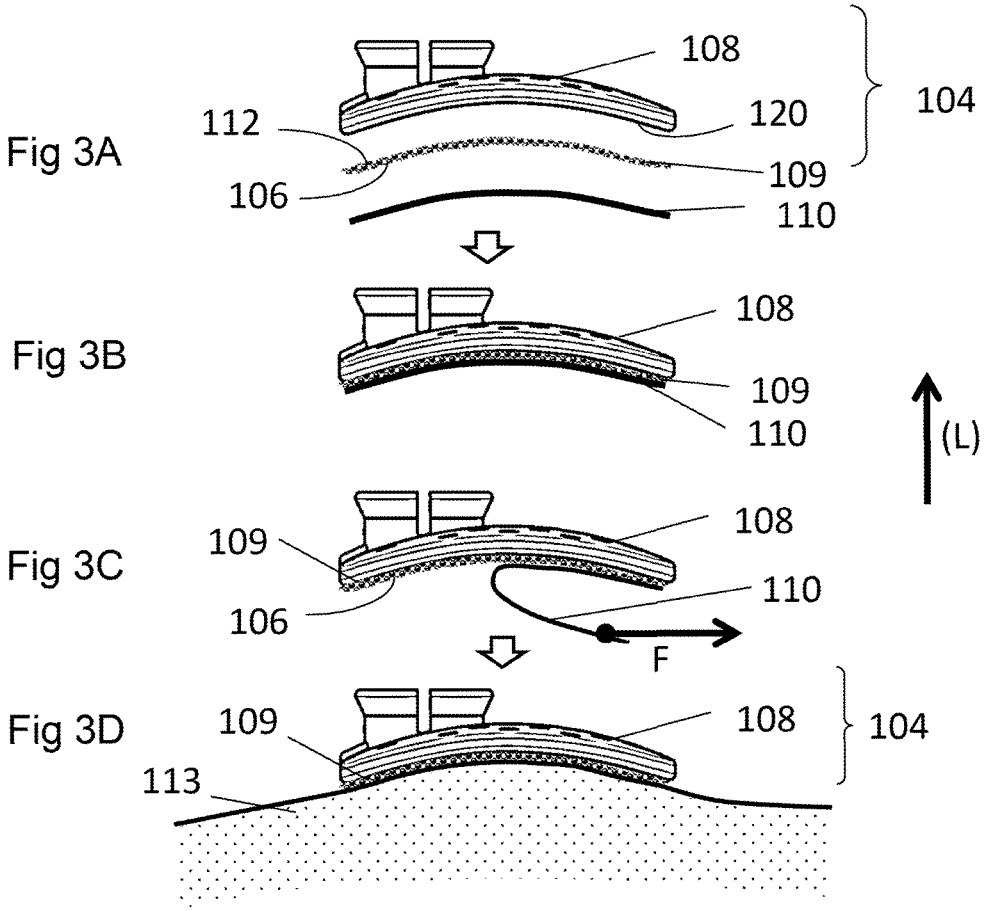
FIG. 3A is a side view of the skin interface of the present invention with an adhesive surface and protective part separated from the skin interface.
FIG. 3B is a side view of the embodiment shown in FIG. 3A with the adhesive surface and protective part attached to the skin interface.
FIG. 3C is a side view of the embodiment shown in FIG. 3B with the protective part partially removed.
FIG. 3D is a side view of the embodiment shown in FIG. 3C with the protective part fully removed and the embodiment attached to a skin portion of a user.

FIGS. 3A-3D are side views of the composition (FIG. 3A and FIG. 3B) and the application (FIG. 3C and FIG. 3D) of the skin interface 104 of the bone conduction hearing aid system of the present invention. A lateral direction (L) has been marked. In FIG. 3A the following separated parts are shown before assembly in manufacturing: the skin interface 104 has an outer interface surface 108, an inner interface surface 120 and an adhesive surface 109 that may be a double-sided adhesive sheet, and a protective sheet 110 that is useful to protect a contra-lateral skin adhesive 106 of the adhesive surface 109 during transportation and also prevents the adhesive from attaching to the skin of a user when trying out a suitable curvature version of the skin interface 104 for a specific user. The protective sheet 110 may be a polymer sheet.

A user friendly feature is that the skin adhesive 109 (such as a double-sided adhesive sheet) is adapted to be applied to the skin and that it allows oxygen to penetrate therethrough. It is also possible for the user to remove the skin interface 104 completely, for example, during a night so that the skin is not permanently interfered with and can "breathe" and function normally when the patient does not need to use the bone conduction hearing aid system 100. It may also be possible to configure the skin adhesive 109 as an adhesive material, such as glue, that is directly applied to the inner interface surface 120 instead of configuring it as a double-side adhesive sheet. However, the use of a double-sided adhesive sheet may be efficient in manufacturing when applying a contra-lateral skin adhesive 109 to the inner interface surface 120. The skin adhesive 109 has an outer skin adhesive surface 112 facing the inner interface surface 120. Instead of using an adhesive on the outer skin adhesive surface 112, it is also possible to use other removable attachment mechanisms such as Velcro or separate glue. Since the skin adhesive 109 may be removably attached to the inner interface surface 120, it is also possible to change the sheet of the skin adhesive 109 if this is more cost efficient than to take a complete new skin interface 104 that includes a new skin adhesive 109.

In FIG. 3B, the parts shown in FIG. 3A have been assembled so that the double-sided sheet of the skin adhesive 109 has been adhered to the inner interface surface 120, and the protective sheet 110 has been attached to the inner skin adhesive surface 106 so that the entire unit is ready for transportation. In FIG. 3C, the protective sheet 110 is removed from the inner skin adhesive surface 106 by applying a force (F) to expose the contra-lateral inner skin adhesive surface 106. In FIG. 3D, the skin interface 104 with its double-sided sheet skin adhesive 109 has been adhesively attached to the skin 113 on the head of a user.

Figure 10:
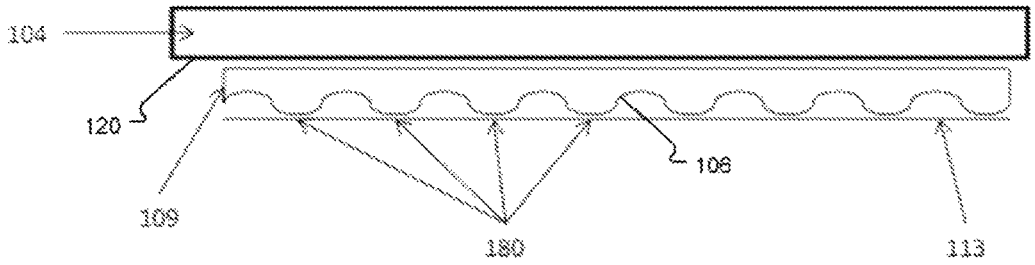
FIG. 10 is close up view of a section of the adhesive surface according to an embodiment of the present invention.

When attached to the skin interface 104, the inner skin adhesive surface 106 of the skin adhesive 109 facing the skin 113 may have an uneven surface texture as shown in FIG. 10 in the scale of 0.1 mm to 1 mm between peaks and valleys. This uneven surface texture may have the advantage that during an initial engagement period immediately after placing the inner skin adhesive surface 106 on the skin 113, there is only contact between the protruding portions 180 of the skin adhesive 109 and the skin 113. Therefore, during the initial engagement period, there is a reduced initial adhesive force which allows the skin interface 104 to be relatively easily removed and relocated, if e.g. the placement needs to be changed to optimize it for the user. After the initial engagement period, e.g. a couple of minutes to half an hour, more of the adhesive material in the skin adhesive 109 is in contact with the skin 113 due to the viscosity and tackiness of the adhesive, thus increasing the adhesive contact area between the skin interface 104 and the skin 113, resulting in relatively stronger full adhesive force between the skin interface 104 and the skin 113 that promotes a fixed secure connection that resists (unintentional) removal of the skin adhesive 109.

Figure 4:
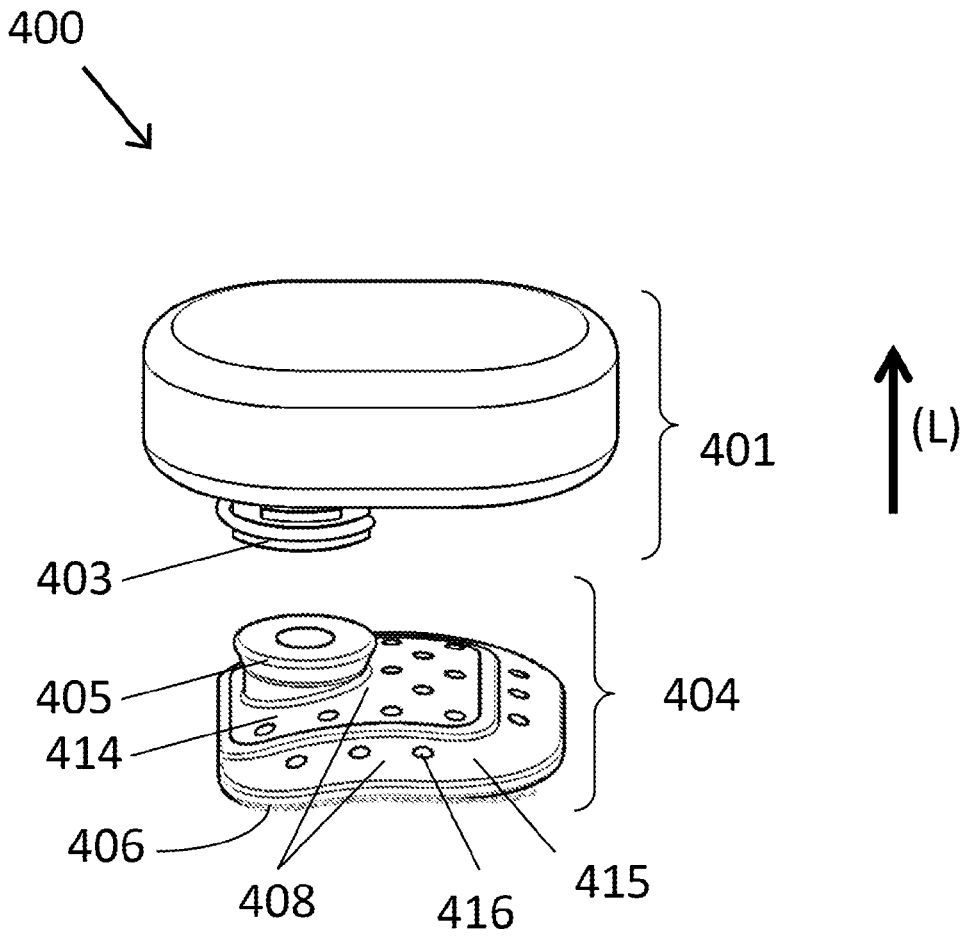
FIG. 4 is a perspective side view of an embodiment of the bone conduction hearing aid system of the present invention with a flexible female connection portion of the hearing aid device and a corresponding male connection portion on the first side of the skin interface.

FIG. 4 is a perspective side view of another embodiment of a bone conduction hearing aid system 400. A hearing aid device 401 has a housing connector 403. A skin interface 404 has an outer interface side 408, a conical-shaped interface connector 405, and a skin adhesive 406 on its inner contra-lateral side. The bone conduction hearing aid system 400 is similar to the embodiment shown in FIG. 1, however, the housing connector 403 and the interface connector 405 are different, and the skin interface 404 has a flexible outer ring 415.

The housing connector 403 is a female coupling that has a flexible portion and a recess defined therein. The interface connector 405 may be a rigid male coupling so that the flexible female coupling of the housing connector 403 can be snapped onto the male coupling of the interface connector 405. Because an inner diameter of the recess of the flexible female coupling is slightly smaller than an outer diameter of the male coupling, the flexible and elastic female coupling of housing connector 403 generates a coupling force about the male coupling of the interface connector 405 that keeps the hearing aid device 401 and the skin interface 404 together. The housing connector 403 also acts as a member around the protruding interface connector 405 that hinders the hearing aid device 401 from sliding off the skin interface 404 in a sideways direction (i.e. a direction perpendicular to a lateral direction (L)).

The skin adhesive 406 on the contra-lateral side of the skin interface 404 is preferably attached to a skin surface behind the auricle of the user ear (best shown in FIG. 2). The outer interface surface 408 has a rigid inner portion 414 and a softer flexible and bendable peripheral outer ring 415 to facilitate adhesion of the skin adhesive 406 to various curvature skin surfaces. Because the rigid inner portion 414 is sufficiently rigid, it makes it easier for the user to separate the housing connector 403 from the interface connector 405, especially when disconnecting, so that the hearing aid device 401 is tilted in relation to the skin interface 404. It is helpful for the wearing comfort of the user that there is a soft cushioning layer 419 between the rigid inner portion 414 and the skin adhesive 406. This cushioning layer 419 may be made of the same material as the softer flexible and bendable peripheral outer ring 415. The rigid inner portion 414 may be attached to the surface of this soft cushioning layer 419, or it may be partially embedded in the cushioning layer 419. The skin interface 404 include multiple through holes 416 for air and moisture transportation to and from the skin through the skin interface 404.

Figure 5A:
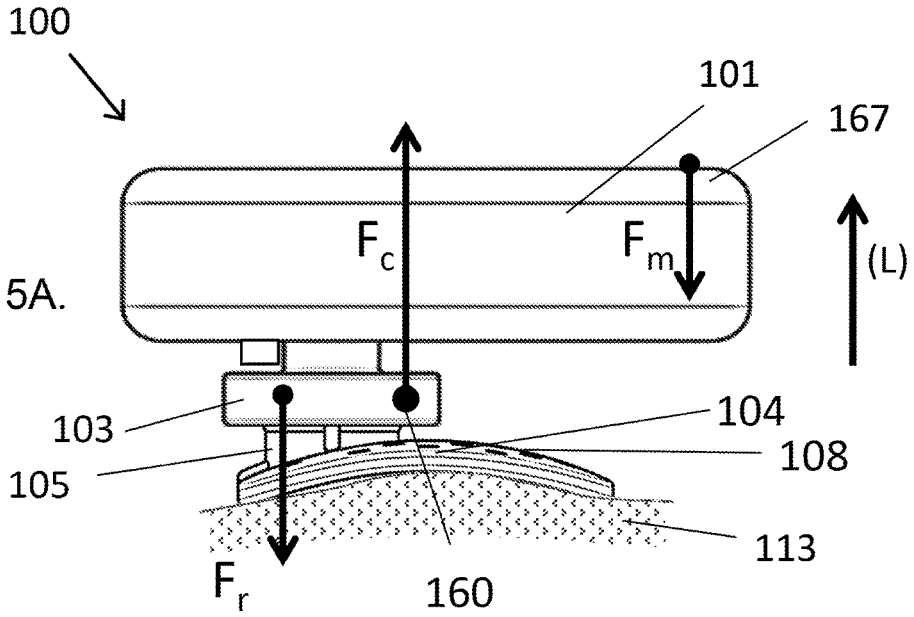
FIG. 5A is a side view of an alternative embodiment of the bone conduction hearing aid system of the present invention.
Figure 5B:
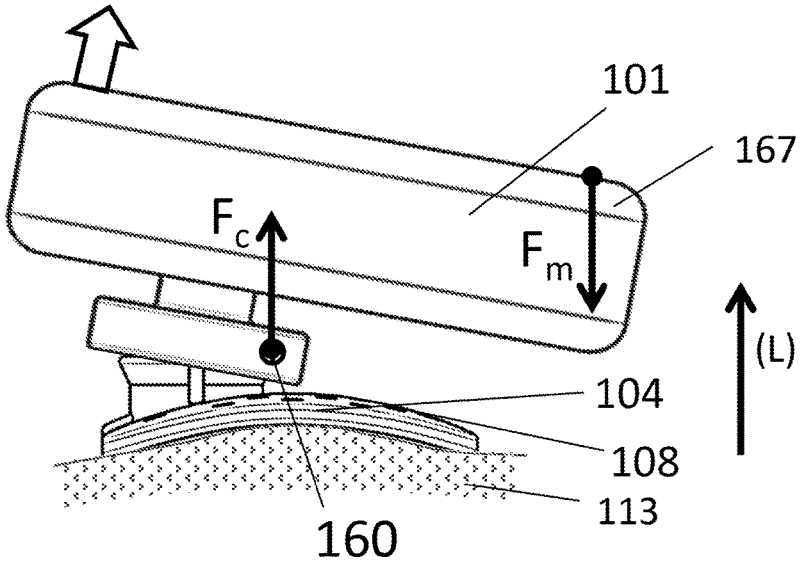
FIG. 5B is a side view of the embodiment shown in FIG. 5A in a tilted position.

FIGS. 5A and 5B are side views of the bone conduction hearing aid system 100 of the present invention having the hearing aid device 101 and the skin interface 104. FIGS. 5A and 5B are intended to visualize the process when disconnecting the hearing aid device 101 from the skin interface 104 by applying a manual tilting force (Fm) on the hearing aid device 101. The skin interface 104 is adhesively attached to the skin 113. In FIG. 5A, the inward manual force (Fm) in the contra-lateral direction is applied to an outer top side 167 of the hearing aid device 101. The outer top side 167 of the hearing aid device 101 is located away from the housing connector 103. The manual force (Fm) creates a torque that is counter-acted by a counter-acting force (Fc) in a rotation contact spot 160 in the interface between the housing connector 103 and the interface connector 105, and by a retention force (Fr). The retention force (Fr) is established by the flexible conical interface connector 105 connected to or inserted into a recess in the rigid female housing connector 103. In FIG. 5B, the retention force (Fr) has been overcome and the hearing aid device 101 is rotated or tilted off from the skin interface 104 about the rotation contact spot 160. As explained in more detail above, the outer interface surface 108 may, preferably, have a sufficiently rigid portion that partially or fully covers the outer interface surface 108 so that the skin interface 104 can counteract the manual force (Fm) against the skin 113, and so that the skin interface 104 does not undesirably bend because a bending or deformation of the skin interface 104 may prevent the manual force (Fm) from disconnecting the hearing aid device 101 from the skin interface 104 when the user is applying the manual tilting force (Fm). With this configuration, the hearing aid device 101 may be disconnected from the skin interface 104 with manual forces that includes a force also in contra-lateral direction which minimizes the risk of the skin interface 104 being torn off from the skin 113 when the hearing aid device 101 is disconnected from the skin interface 104.

Figure 6:
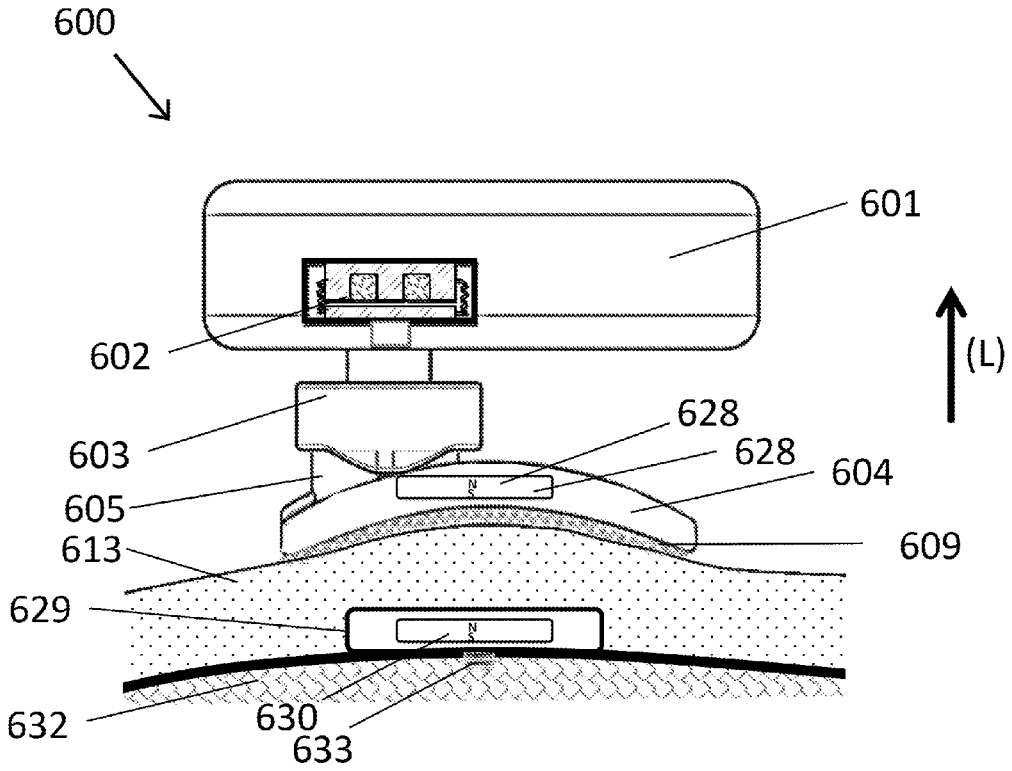
FIG. 6 is a cross-sectional side view of an embodiment of the bone conduction hearing aid system of the present invention including magnetic material in an implanted unit under the skin and a corresponding magnetic material in the skin interface.

FIG. 6 is a cross-sectional side view of another embodiment of a bone conduction hearing aid system 600. A hearing aid device 601 has a hearing aid vibrator 602 and a housing connector 603. A skin interface 604 has an interface connector 605 and an adhesive surface 609 that is adhesively connectable to skin 613 of the user. The skin interface 604 includes an external magnet material 628. An implant device 629 includes an implant magnet 630, so that the skin interface 604 and implant device 629 are connectable to each other by magnetism. The implant device 629 is located under the skin 613 and it is fixed to the skull bone 632 by a bone fastener 633. The magnetic attraction between the external magnet 628 and the implant magnet 630 presses the skin interface 604 towards the skin 613 to enhance sound transmission and to facilitate positioning of the skin interface 604 when attaching its adhesive surface 609 to the skin 613. The skin interface 604 and the hearing aid device 601 are substantially retained on the user by the adhesive surface 609 of the skin interface 604, although the magnetic interaction also contributes to the retention. The housing connector 603 may include a permanent magnet and the interface connector 605 may include a ferromagnetic material so that the coupling between the skin interface 604 and the hearing aid device 601 also is established by magnetic interaction. This design may also contribute to improving sound transmission by creating a slight pressure on the skin. The hearing aid device may also include an ear hook to further secure the device.

Figure 7A:
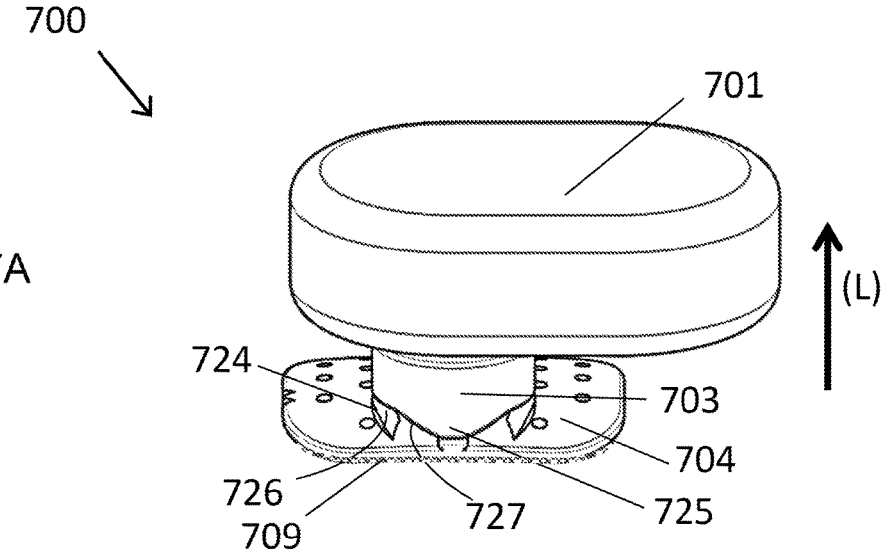
FIG. 7A is a perspective side view of an embodiment of the bone conduction hearing aid system of the present invention in a connected position.
Figure 7B:
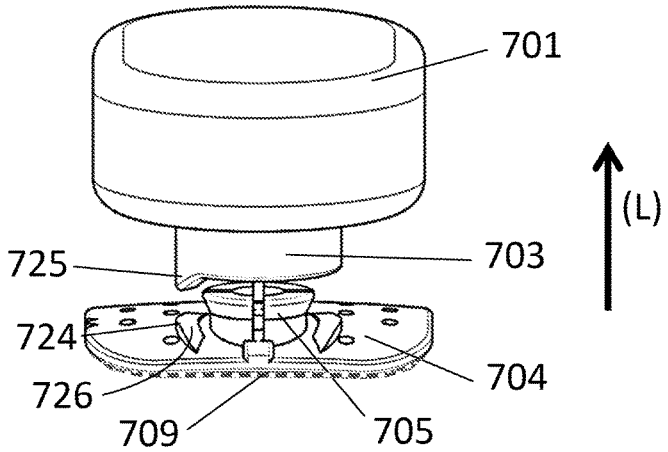
FIG. 7B is a perspective side view of the embodiment shown in FIG. 7A in a disconnected position.

FIGS. 7A and 7B are perspective side views of another embodiment of a bone conduction hearing aid system 700. In FIG. 7A, a hearing aid device 701 is connected to a skin interface 704, and in FIG. 7B, the hearing aid device 701 has been disconnected from the skin interface 704. The bone conduction hearing aid system 700 is similar to the embodiment of FIG. 1. However, the bone conduction hearing aid system 700 also includes a disconnecting arrangement to facilitate the disconnection of the hearing aid device 701 from the skin interface 704. In FIG. 7B, the hearing aid device 701 has been rotated 90 degrees in a clockwise direction about an axis parallel to the lateral direction (L) in relation to the skin interface 704 compared to the position of the hearing aid device 701 in FIG. 7A. The hearing aid device 701 has a housing connector 703 and a housing disconnector 725 with a sloping contact surface 727. The skin interface 704 has an interface connector 705 and a skin interface disconnector 724 with a sloping contact surface 726. The skin interface 704 also has an adhesive surface 709 that can be attached to a skin of a user, as described earlier. The lateral direction (L) is marked and a contra-lateral direction is opposite to the lateral direction (L).

The housing connector 703 can be a rigid female connector, and the interface connector 705 can be a male connector with flexible spring arms so that the housing connector 703 can be snapped on to it. The housing disconnector 724 extends further in the lateral direction than the most contra-lateral portion of the skin interface disconnector 725. When the hearing aid device 701 is rotated in the clockwise direction about a geometric center axis (parallel to the lateral direction) extending through a respective center portion of the disconnectors in FIG. 7A, the sloping contact surface 726 come in contact with the sloping contact surface 727 so that the rotational force creates an axial force parallel to the lateral direction (L) that drives the housing connector 703 and the interface connector 705 to disconnect from one another. In this way, the hearing aid device 701 can be rotated to disconnect it from the skin interface 704 instead of pulling it off with a force in lateral direction (L) which may cause the adhesive surface 709 to be torn off from the skin of the user. The disconnection arrangement may be designed in various specific ways depending on the design of the coupling. For example, the hearing aid device 701 may be disconnected from the skin interface 704 by turning the units in a counter-clockwise direction relative to one another. A disconnection arrangement may also be designed as a control handle so that a user can press a handle to counteract the coupling force to gently disconnect the hearing aid device 701.

Figure 8:
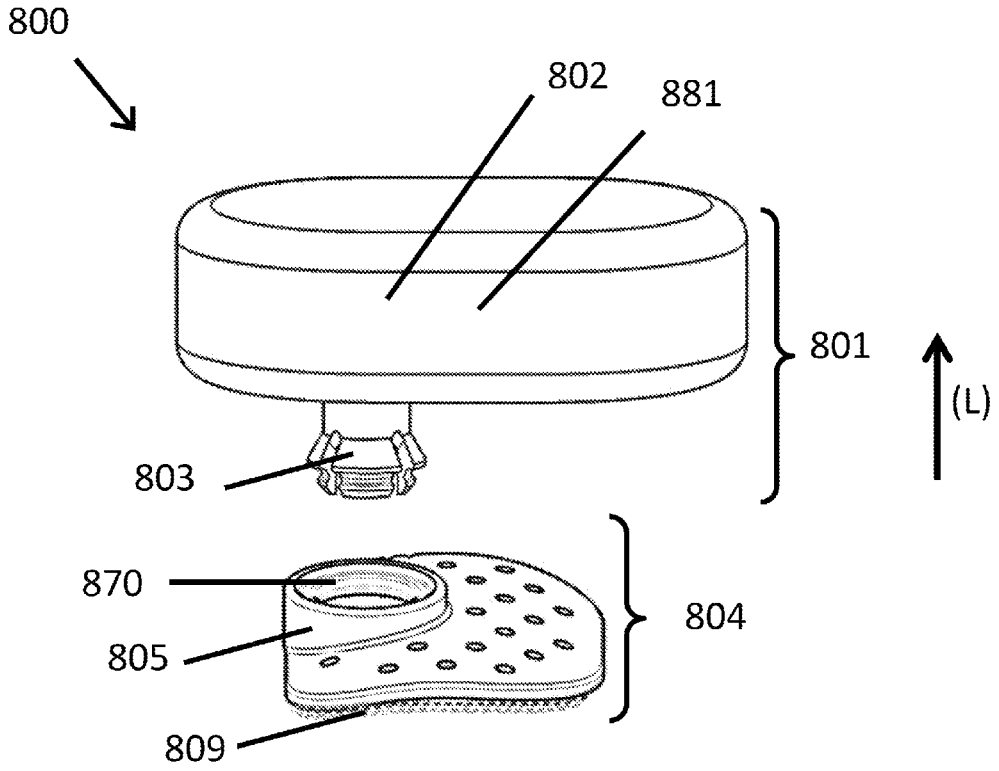
FIG. 8 is a perspective side view of an embodiment of the bone conduction hearing aid system of the present invention with a flexible male connection portion of the hearing aid device and a corresponding female connection portion on a first side of the skin interface.

FIG. 8 is a perspective side view of another embodiment of a bone conduction hearing aid system 800. The embodiment shown in FIG. 8 is very similar to the embodiment shown in FIG. 1 except that the positions of the male and female connections have been switched so that the female coupling is on the skin interface 804 while the male coupling is on the hearing aid device 801. More particularly, a hearing aid device 801 has a male housing connector 803. A skin interface 804 has a female interface connector 805 and an adhesive surface 809. The housing connector 803 is a flexible male coupling so that it can be removably snapped into the female interface connector 805. The female interface connector 805 has a recess 870 defined therein so that the housing connector 803 can be retained to the interface connector 805. The way the male housing connector 803 connects to the female interface connector 805 is substantially similar to the embodiment of FIG. 1 except that the male and female portions have been switched. More particularly, the housing connector 803 generates a coupling force that keeps the hearing aid device 801 and the skin interface 804 together. The female interface connector 805 also acts as a member around the housing connector 803 to prevent the hearing aid device 801 from sliding off from the skin interface 804 in a sidewise direction (i.e. a direction perpendicular to a lateral direction (L)). The skin adhesive 809 allows the skin interface 804 to be removably connected to a skin of the user. The hearing aid device 801 here includes a tinnitus masking signal generator 881. The signal from the tinnitus masking signal generator 881 is transferred into vibrations by the hearing aid vibrator 802 that is also located in the hearing aid device 801 and the vibrations are then transmitted to the hearing organ through bone conduction.

The hearing aid vibrator in any of the above specific embodiments may be any suitable type of vibrator such as an electromagnetic vibrator or a piezoelectric vibrator. The amplifier of the hearing aid device may, for example, include digital processing, directional microphones, noise reduction, feedback suppression and other electronic and software features that are beneficial and used in any suitable type of regular hearing aid. The hearing aid device may consist of one housing unit where all electronics are included, or it may consist of two or more separate housing units where different parts of the electronics are included in the different housings and where the separate housing units communicate with each other via wire or wireless communication. The skin interface may have a bulb or knob in part of the area facing the skin to create a local light pressure against the skin to further enhance sound transmission.

Figure 9:
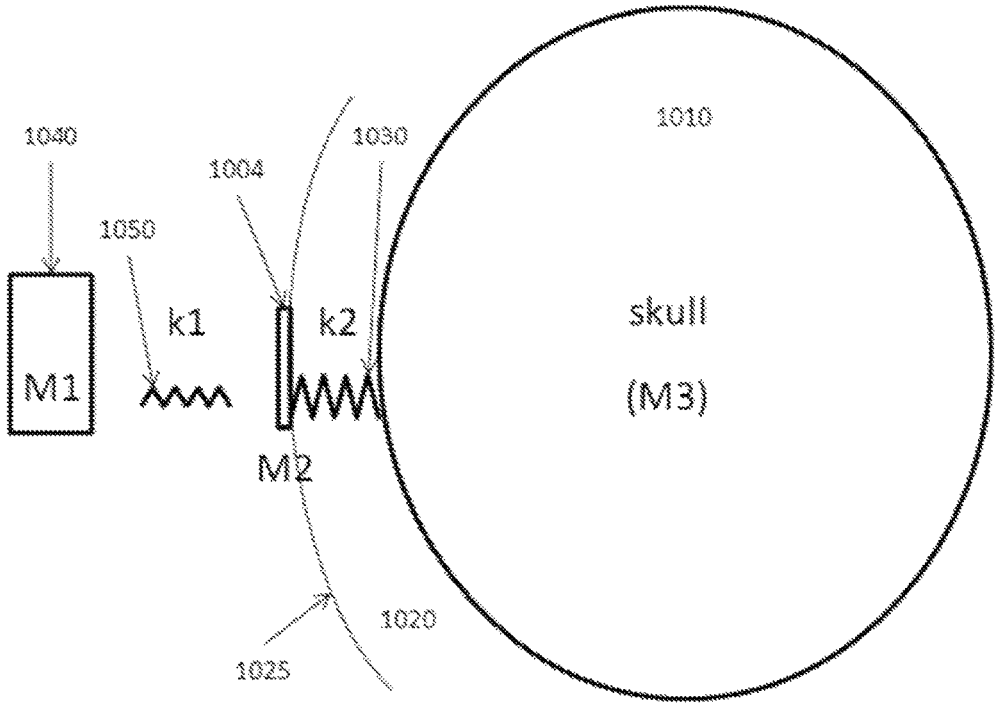
FIG. 9 shows the spring constant relationships that are present in various embodiments of the present invention.

Embodiments of the present invention provide a unique design of an integrated skin interface that enables the skin interface to be manufactured so that it has a very low weight in relation to the weight of the oscillating mass of the hearing aid device which is a key factor to achieve an efficient transmission of the vibrations from the hearing aid to the skull bone of a user. In specific embodiments of the present invention, as illustrated by FIG. 9, the mass ratio between the hearing aid device and the skin interface is a critical number. Unlike in conventional percutaneous bone conduction systems that have a fixed connection between an abutment and the skull bone, here there is soft tissue 1020 (e.g. skin 1025, fatty tissue, etc.) between the (supercutaneous) skin interface 1004 and the underlying skull bone 1010 (represented by mass M3 in FIG. 9). This soft tissue 1020 acts a sort of spring element 1030 with a quasi-spring constant k2. The connection between a vibrator oscillating mass of hearing aid device 1040 (having mass M1) and skin interface 1004 (having mass M2) can be thought of as a spring 1050 having a spring constant k1. In order to effectively transfer vibratory energy from the vibrator oscillating mass hearing aid device 1040 to the skull 1010, the mass ratio between the hearing aid device 1040 and the skin interface 1004 should be at least 5:1, preferably greater than 10:1.

Figure 11:
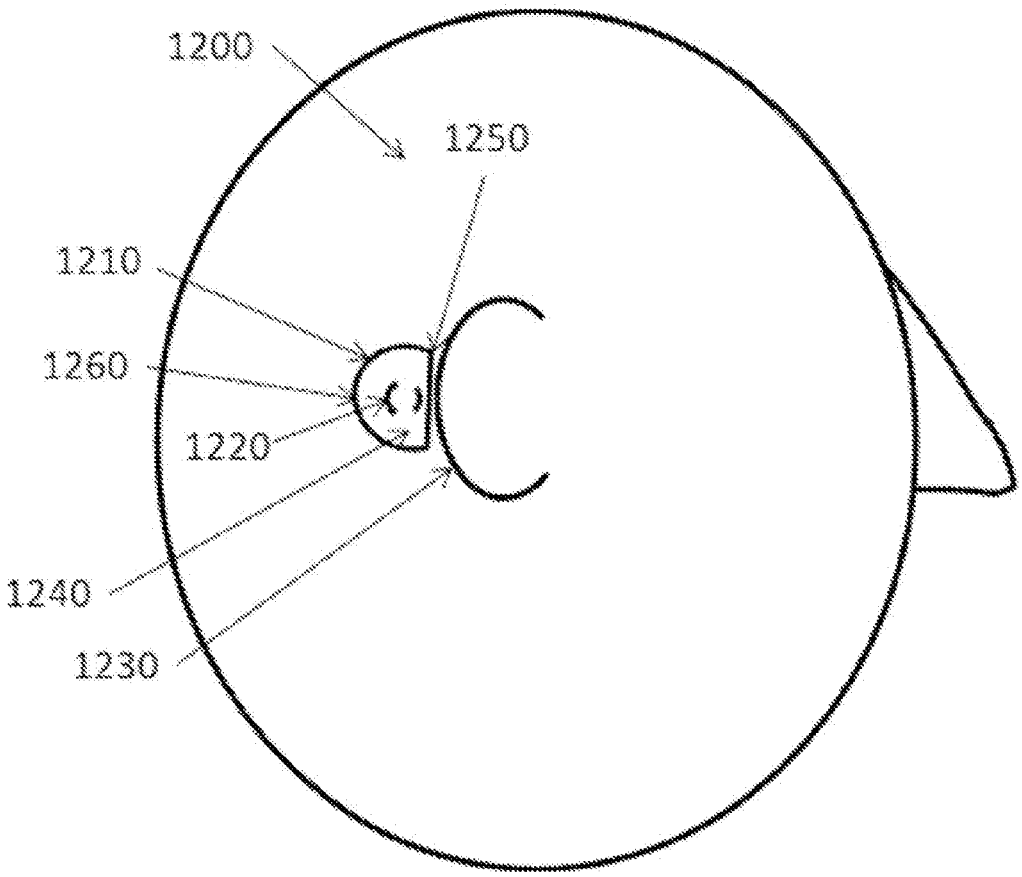
FIG. 11 shows the center of mass and asymmetric characteristics according to an embodiment of the present invention.

FIG. 11 shows a side view of a specific embodiment with a user 1200 wearing a hearing aid device 1210 having a skin interface (indicated by dashed circle) 1220 behind the auricle 1230. The hearing aid device 1210 has an upper surface 1240 which is asymmetric and has a geometrical center of mass that is, when worn by the user 1200, closer to the front edge 1250 that is placed nearest to the auricle 1230, than to an opposite rear edge 1260. In addition, the housing connector and interface connector consequently also are closer to the front edge 1250 than to the rear edge 1260 if they substantially coincide with this geometrical center of mass (as is generally the case). In a further specific embodiment, the mass distribution of the entire hearing aid system has a center of mass which may substantially lie on a line defined by the center axis of the two connectors. If the connectors are cylindrical, then this line coincides with the longitudinal cylindrical axis of the connectors. Similar types of axes can be defined if the shapes of the connectors are triangular, quadrilateral, oval annulus, etc. Consequently, the center of mass may be closer to the front edge 1250 than to the rear edge 1260. In particular, the center of mass may be close to the auricle 1230. However, at the same time the hearing aid device 1210 should not be in direct contact (should not touch) the auricle 1230 itself to avoid undesired vibrational feedback.

The present invention provides several advantages and allows a bone conductor hearing aid device to be retained on the skin with an adhesive that still allows the user to remove the hearing aid device without having to tear the adhesive off the skin. A substantial part of the skin interface can be located between the hearing aid device and the skin of the user. The bone conduction hearing aid system can then be considerably limited in total size. In many cases it can be possible to fully place the skin interface on the naturally non-hair bare area behind the auricle without requiring additional arrangements on other parts on the user head. The hearing aid device can be easily connected to and disconnected from the skin interface without the coupling being sensitive to water or dirt; for example, when connecting the hearing aid device to the skin interface after taking a shower (the hearing aid device may not be waterproof whereas the skin interface may stay attached to the skin).

Other advantages are that the hearing aid device can be standardized since the coupling to the skin interface can be the same for more or less all patients, which is important since the hearing aid device can be quite expensive. The skin interface that is more frequently changed and fairly cost efficient to manufacture can, however, easily be manufactured in various shapes and sizes to fit different users.

Another advantage is that embodiments of the invention enable attaching the skin interface to the skin in a separate process from the connection of the hearing aid device. The attachment of the adhesive skin interface can be done accurately in a controlled situation, for example, in front of a mirror at home, and the skin interface will then stay in this position until it is removed after one or several days of usage. The hearing aid device may then be connected to the skin interface later in less controlled situations during the day, and, as long as the skin interface is correctly placed, the hearing aid device will automatically be correctly positioned on the head; for example, when connecting the hearing aid device to the skin interface on the beach after a swim. The skin interface which adheres to the skin can be changed at an interval that is suitable for the skin, which may be every night or it may, for example, be more seldom, like every third day or once a week. The skin can then rest during a night when the skin interface is not attached.

Although various exemplary embodiments of the invention have been disclosed, it should be apparent to those skilled in the art that various changes and modifications can be made which will achieve some of the advantages of the invention without departing from the true scope of the invention.

What is claimed is:

1. A bone conduction hearing aid system comprising:

a hearing aid housing containing:

a hearing aid vibrator configured for generating sound vibrations, and a housing connector configured for coupling out the sound vibrations from the hearing aid vibrator; and a skin interface having:

opposing inner and outer interface surfaces, each having a front end and a rear end, wherein the front end is configured to be closer to an auricle of the ear of a patient user when the skin interface is attached to the patient user, an interface connector located on the outer interface surface closer to the rear end than to the front end and detachably connected to the housing connector to couple in the sound vibrations, and a skin adhesive located on the inner interface surface and configured to adhesively connect to skin of the patient user to transmit the sound vibrations through the skin to underlying skull bone for transmission by bone conduction to a hearing organ of the user;

wherein the skin adhesive is characterized by a surface texture characterized by structural peaks and valleys so that when the skin adhesive is pressed against the skin of the user:

the skin is initially engaged during an initial engagement period with an initial adhesive force that promotes removal and relocation of the skin interface, and the skin is fully engaged after the initial engagement period with a full adhesive force greater than the initial adhesive force that promotes a fixed secure connection that resists removal of the skin interface.

2. The bone conduction hearing aid system according to claim 1, wherein the surface texture is characterized by structural peaks and valleys in the range of 0.1 mm to 1 mm.

3. The bone conduction hearing aid system according to claim 1, further comprising:

an implanted magnet fixedly attached to the skull bone under the skin of the patient user, wherein the skin interface includes an external magnet configured to magnetically cooperate with the implanted magnet to couple the sound vibrations through the skin to the skull bone.

4. The bone conduction hearing aid system according to claim 1, wherein the skin interface includes at least one through hole extending between the inner and outer interface surfaces.

5. The bone conduction hearing aid system according to claim 1, wherein the housing connector and the interface connector possess a common center axis about which the hearing aid housing is rotatable.

6. The bone conduction hearing aid system according to claim 1, wherein the hearing aid vibrator is suspended within the hearing aid housing so as to acoustically isolate the hearing aid vibrator from the hearing aid housing.

7. The bone conduction hearing aid system according to claim 1, wherein the hearing aid housing and the skin interface each include magnets configured so that the housing connector and the interface connector are detachably magnetically connected.

8. A bone conduction hearing aid system comprising:

a hearing aid housing containing:

i. a hearing aid vibrator configured for generating sound vibrations, and ii. a housing connector configured for coupling out the sound vibrations from the hearing aid vibrator; and a skin interface having:

i. rigid opposing inner and outer interface surfaces, each having a front end and a rear end, wherein the front end is configured to be closer to an auricle of the ear of a patient user when the skin interface is attached to the patient user, ii. an interface connector located on the outer interface surface closer to the rear end than to the front end and detachably connected to the housing connector to couple in the sound vibrations, iii. a skin adhesive located on the inner interface surface and configured to adhesively connect to skin of the patient user to transmit the sound vibrations through the skin to underlying skull bone for transmission by bone conduction to a hearing organ of the user, and iv. a cushioning layer in compliant engagement between the rigid inner interface surface and the skin adhesive to promote comfortable engagement of the hearing aid system with the skin of the patient user.

9. The bone conduction hearing aid system according to claim 8, wherein the rigid opposing inner and outer interface surfaces are surrounded by an outer ring of flexible material.

10. The bone conduction hearing aid system according to claim 9, wherein the cushioning layer is made of the same flexible material as the outer ring.

11. The bone conduction hearing aid system according to claim 8, wherein the rigid opposing inner and outer interface surfaces are at least partially embedded within the cushioning layer.

12. The bone conduction hearing aid system according to claim 8, further comprising:

an implanted magnet fixedly attached to the skull bone under the skin of the patient user, wherein the skin interface includes an external magnet configured to magnetically cooperate with the implanted magnet to couple the sound vibrations through the skin to the skull bone.

13. The bone conduction hearing aid system according to claim 8, wherein the skin interface includes at least one through hole extending between the inner and outer interface surfaces.

14. The bone conduction hearing aid system according to claim 8, wherein the housing connector and the interface connector possess a common center axis about which the hearing aid housing is rotatable.

15. The bone conduction hearing aid system according to claim 8, wherein the hearing aid vibrator is suspended within the hearing aid housing so as to acoustically isolate the hearing aid vibrator from the hearing aid housing.

16. The bone conduction hearing aid system according to claim 8, wherein the hearing aid housing and the skin interface each include magnets configured so that the housing connector and the interface connector are detachably magnetically connected.

17. A bone conduction hearing aid system comprising:

a hearing aid housing having a housing mass and containing:

i. a hearing aid vibrator configured for generating sound vibrations, and ii. a housing connector configured for coupling out the sound vibrations from the hearing aid vibrator; and a skin interface having an interface mass and including:

i. opposing inner and outer interface surfaces, each having a front end and a rear end, wherein the front end is configured to be closer to an auricle of the ear of a patient user when the skin interface is attached to the patient user, ii. an interface connector located on the outer interface surface closer to the rear end than to the front end and detachably connected to the housing connector to couple in the sound vibrations, and iii. a skin adhesive located on the inner interface surface and configured to adhesively connect to skin of the patient user to transmit the sound vibrations through the skin to underlying skull bone for transmission by bone conduction to a hearing organ of the user;

wherein the housing mass is at least five times greater than the interface mass.

18. The bone conduction hearing aid system according to claim 17, wherein the housing mass is at least ten times greater than the interface mass.

19. The bone conduction hearing aid system according to claim 17, further comprising:

an implanted magnet fixedly attached to the skull bone under the skin of the patient user, wherein the skin interface includes an external magnet configured to magnetically cooperate with the implanted magnet to couple the sound vibrations through the skin to the skull bone.

20. The bone conduction hearing aid system according to claim 17, wherein the skin interface includes at least one through hole extending between the inner and outer interface surfaces.

21. The bone conduction hearing aid system according to claim 17, wherein the housing connector and the interface connector possess a common center axis about which the hearing aid housing is rotatable.

22. The bone conduction hearing aid system according to claim 17, wherein the hearing aid vibrator is suspended within the hearing aid housing so as to acoustically isolate the hearing aid vibrator from the hearing aid housing.

23. The bone conduction hearing aid system according to claim 17, wherein the hearing aid housing and the skin interface each include magnets configured so that the housing connector and the interface connector are detachably magnetically connected.

* * * * *